United States Patent [19]

Haney

[11] Patent Number: 4,533,055

[45] Date of Patent: Aug. 6, 1985

[54] STORAGE RACK FOR DRILLING TUBULARS

[75] Inventor: Keith M. Haney, Wichita Falls, Tex.

[73] Assignee: Walker-Neer Manufacturing Co., Inc., Wichita Falls, Tex.

[21] Appl. No.: 384,405

[22] Filed: Jun. 2, 1982

[51] Int. Cl.[3] ..... A47F 7/00

[52] U.S. Cl. ..... 211/70.4; 211/1.5; 198/492; 193/38; 193/40; 414/22; 248/354.3; 175/52; 221/298

[58] Field of Search ..... 211/60 S, 1.5, 49 D; 198/492; 193/38, 40, 15; 414/748, 22, 745, 469, 474; 248/352, 354 H, 354 S; 108/7, 8; 175/52; 221/295, 298

[56] References Cited

U.S. PATENT DOCUMENTS

| | | | |
|---|---|---|---|
| 278,022 | 5/1883 | Kline | 193/40 |
| 845,152 | 2/1907 | Weir | 193/40 |
| 1,721,835 | 7/1929 | Schnell | 193/40 |
| 2,666,462 | 1/1954 | Richardson | 414/748 |
| 2,790,683 | 4/1957 | Clark | 211/60 S |
| 3,093,251 | 6/1963 | Bender | 211/60 S X |
| 3,222,030 | 12/1965 | Thorpe | 248/354 S |
| 3,667,621 | 6/1972 | Barlow | 193/40 X |
| 3,690,608 | 9/1972 | Poizner | 248/354 S X |
| 3,699,898 | 10/1972 | Nolan | 248/354 S X |
| 3,920,212 | 11/1975 | Westwood | 248/352 X |
| 3,999,684 | 12/1976 | Ekholm | 193/40 X |
| 4,042,123 | 8/1977 | Sheldon et al. | 211/60 S X |
| 4,361,223 | 11/1982 | Johson | 414/748 X |

FOREIGN PATENT DOCUMENTS

| | | | |
|---|---|---|---|
| 460126 | 10/1949 | Canada | 211/60 S |
| 677300 | 6/1939 | Fed. Rep. of Germany | 414/745 |
| 3030576 | 3/1982 | Fed. Rep. of Germany | 193/38 |
| 622495 | 2/1927 | France | 108/7 |
| 69162 | 6/1977 | Japan | 414/748 |
| 162255 | 8/1933 | Switzerland | 248/354 |
| 21124 | of 1903 | United Kingdom | 248/354 S |
| 151963 | 11/1962 | U.S.S.R. | 414/748 |
| 737048 | 5/1980 | U.S.S.R. | 414/745 |

*Primary Examiner*—Ramon S. Britts
*Assistant Examiner*—Blair Johnson
*Attorney, Agent, or Firm*—Willian Brinks Olds Hofer Gilson & Lione Ltd.

[57] ABSTRACT

A rack for supporting drilling tubulars such as drill pipe, collars and the like includes a base and a rail. The rail is coupled to the base by means of two columns, each of which is provided with threads such that the tilt angle of the rail with respect to the base can be adjusted to provide gravity feeding of drilling tubulars to either end of the rail. The rail is provided with two pivotably connected stop plates which move in opposition. The stop plates are controlled by means of an air cylinder to allow only one drilling tubular at a time from those stored on the rack to roll off the end of the rail. Furthermore, both stop plates can be retracted below the level of the rail so as not to interfere with the movement of tubulars onto the rack. The combination of the tiltable rail and the two stop plates provides a rack which can be used to control movement of drilling tubulars on to and off of the rack with a minimum of manpower requirements.

11 Claims, 11 Drawing Figures

STORAGE RACK FOR DRILLING TUBULARS

BACKGROUND OF THE INVENTION

The present invention relates to an improved storage rack for drilling tubulars. Throughout this application the term "drilling tubulars" will be used in its broad sense to encompase drill pipe, drill collars and casing, as well as other types of tubular structures used in connection with boreholes such as production tubing, sucker rods, and the like.

In well drilling and well service operations a large quantity of drilling tubulars must be stored. For example, in well drilling operations drill pipe (which is typically stored horizontally at ground level) must be moved to a vertical position and then coupled to a drill string. Similarly, when a drill string is being removed from a bore hole, consecutive lengths of drill pipe must be removed from the drill string and brought to ground level in a horizontal orientation.

Various types of transfer arms have been devised to speed the handling of downhole tubulars and the transfer of such tubulars between the horizontal, ground level position and the elevated, vertical position aligned with the bore hole. Such transfer arms can significantly reduce the manpower needed to operate a drilling rig.

However, a need exists for an improved rack for drilling tubulars which can act to support the drilling tubulars at ground level in a horizontal orientation, and to feed the stored tubulars from the rack to a transfer arm. Such an improved rack offers the prospect of further significant reductions in the manpower required to operate a drilling rig.

SUMMARY OF THE INVENTION

The present invention is directed to a simple, reliable, and rugged rack which operates with small manpower requirements to control the movement of drilling tubulars stored on the rack.

According to a first feature of this invention, the rack is made up of a frame adapted to rest on the ground and a support rail which is coupled to the frame at two points spaced along the length of the rail. Means such as a hydraulic jack are provided for independently positioning each end of the rail with respect to the frame, and means are also provided for holding the rail at the desired position with respect to the frame. This aspect of the invention allows the tilt angle of the rail with respect to the frame to be adjusted at will, such that the uppermost surface of the rail which supports the drilling tubulars can be made to tilt as desired. Thus, for example, a first end of the rail can be positioned at either a higher or lower elevation than the second end of the rail in order to cause drilling tubulars suported by the rail to tend to roll toward either end of the rail. As will be explained below, this feature of the invention can be used to feed drilling tubulars automatically toward a transfer arm during drilling operations or automatically to feed drilling tubulars away from the transfer arm when a drill string is being disassembled.

According to a second feature of this invention, a rack for drilling tubulars is provided with two stop members which are pivotably mounted to the rack adjacent the rail. The first stop member is pivotable between an upper position, in which a portion of the first stop member extends above the rail, and a lower position, in which the first stop member does not extend above the rail. The second stop member is also pivotably mounted to the frame near the first stop member. This second stop member is also pivotable between an upper position, in which it extends above the rail, and a lower position, in which it does not extend above the rail. Means are provided for causing the first and second stop members to move in opposition such that when the first stop member is in the upper position, the second stop member is in the lower position, and vice versa. The two stop members are so positioned that when the first stop member is in the upper position with a first drilling tubular positioned against the first stop member, and the second stop member is then moved to the upper position, the second stop member fits between the first tubular and adjacent tubular, thereby restraining movement of the adjacent tubular. Preferably, the two stop members are linked together by a tie rod and the position of these stop members is controlled by means of an actuator which is mounted to the rack. This actuator can be used to cycle the first and second stop members in order to cause a single drilling tubular to advance to a selected end of the rack while restraining the movement of further drilling tubulars. In this way, the movement of drilling tubulars stored on the rack can be controlled simply and reliably.

Preferably, these two features of the invention are used together to form an improved tiltable rack for drilling tubulars which includes means for dispensing drilling tubulars one at a time from the rack to a transfer arm or the like. When so used, this invention allows a significant reduction in the manpower required to transfer drilling tubulars either from the rack to a transfer arm, or alternately, from a transfer arm to the rack.

The invention itself, together with further objects and attendant advantages, will best be understood by reference to the following detailed description taken in conjunction with the accompanying drawings.

DETAILED DESCRIPTION OF THE PRESENTLY PREFERRED EMBODIMENTS

Figure 2:
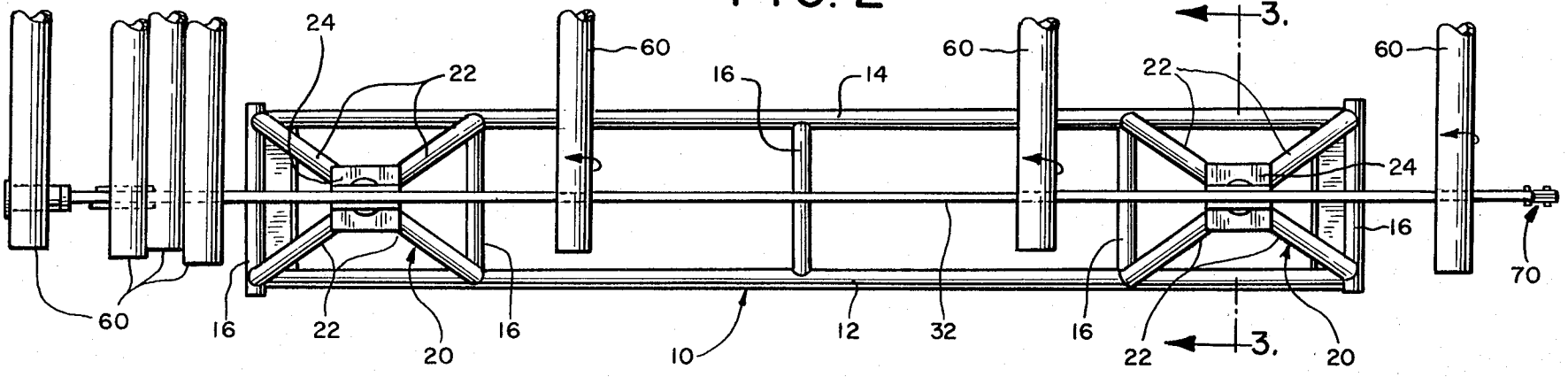
FIG. 2 is a plan view of the embodiment of FIG. 1.
Figure 1:
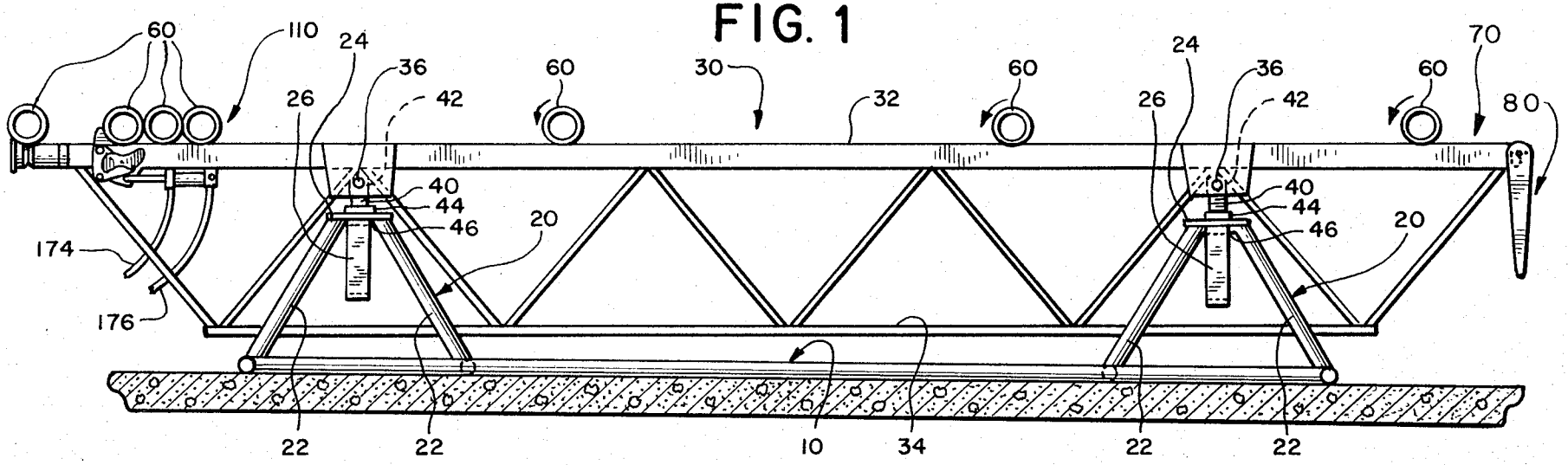
FIG. 1 is a side elevational view of a first preferred embodiment of this invention.

Turning now to the drawings, FIGS. 1 and 2 depict side elevational and plan views, respectively, of a first preferred embodiment of the rack of this invention. As shown in FIGS. 1 and 2, this embodiment includes a base 10 which is made up of a frame of longitudinal pipes 12,14 linked together by cross pipes 16. In this embodiment, the base 10 is formed of steel pipes which are welded together to form a secure foundation for the rack.

Figure 3:
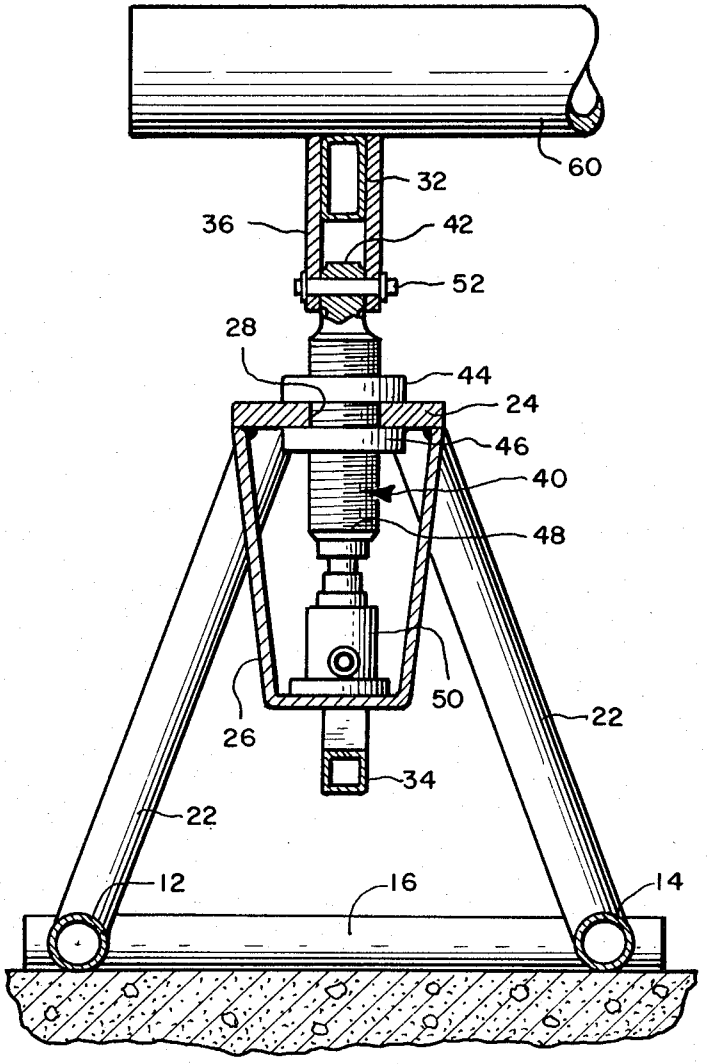
FIG. 3 is a sectional view taken along line 3—3 of FIG. 2.

The base 10 includes two pedestals 20, one at each end of the base 10. Each of the pedestals 20 is formed of four legs 22 which are arranged in a pyramidal shape. The four legs 22 of each pedestal 20 are secured at their upper ends to an upper plate 24. A jack support structure 26, which in this preferred embodiment is made up of a steel plate bent as shown in FIG. 3, is secured to the under side of the plate 24, as for example, by welding. An opening 28 is formed through the center of each of the plates 24. The pedestals 20 are rigidly secured to the base 10 so as to form a single rigid unit.

The embodiment of FIGS. 1 and 2 also includes a support member 30 which in this embodiment is made up of a longitudinally extending rail 32 which is supported by a framework 34. As shown in FIG. 2, the support member 30 is relatively narrow in width, yet deep in section. The support member 30 must be adequately strong to bear the weight of a large number of drilling tubulars, such as drill pipe or collars. Standard engineering principles should be used to select the materials and the dimensions of both the support member 30 and the base 10 to provide the necessary strength. The support member 30 defines two spaced attachment points 36, each of which is aligned with the respective one of the pedestals 20.

As best shown in FIG. 3, each of the attachment points 36 is secured to he respective pedestal 20 by means of a column 40. Each column 40 is a threaded cylinder which defines an upper end 42 and a lower end 48. The upper end 42 of the column 40 is secured to the respective attachment point 36 by means of a pin 52. An upper nut 44 is threadedly engaged on the column 40 above the plate 24, and a lower nut 46 is threadedly engaged on the column 40 below the plate 24. In this embodiment, the lower end 48 is squared off to provide a bearing surface for a jack 50. This jack 50 rests on the jack support structure 26, which provides a reaction point for the jack 50. The jack 50 should be chosen to have adequate capacity to raise the column 40 and the support member 30, even when the support member 30 supports a complete load of drilling tubulars. The lower nuts 46 securely couple the support member 30 to the base 10 and allow the base 10 to be lifted by the support 30 member.

Figure 5:
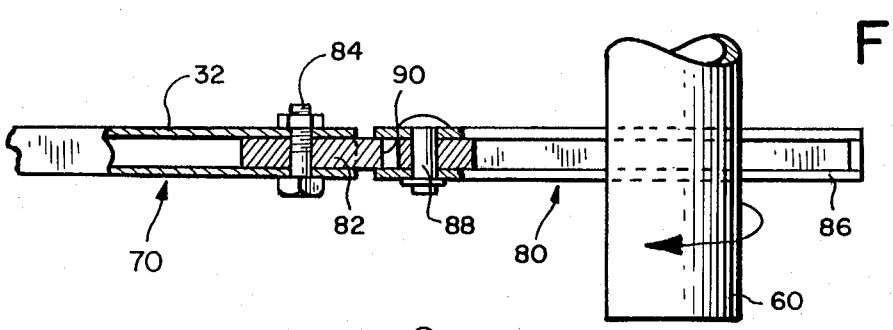
FIG. 5 is a partial sectional view taken along line 5—5 of FIG. 4.
Figure 4:
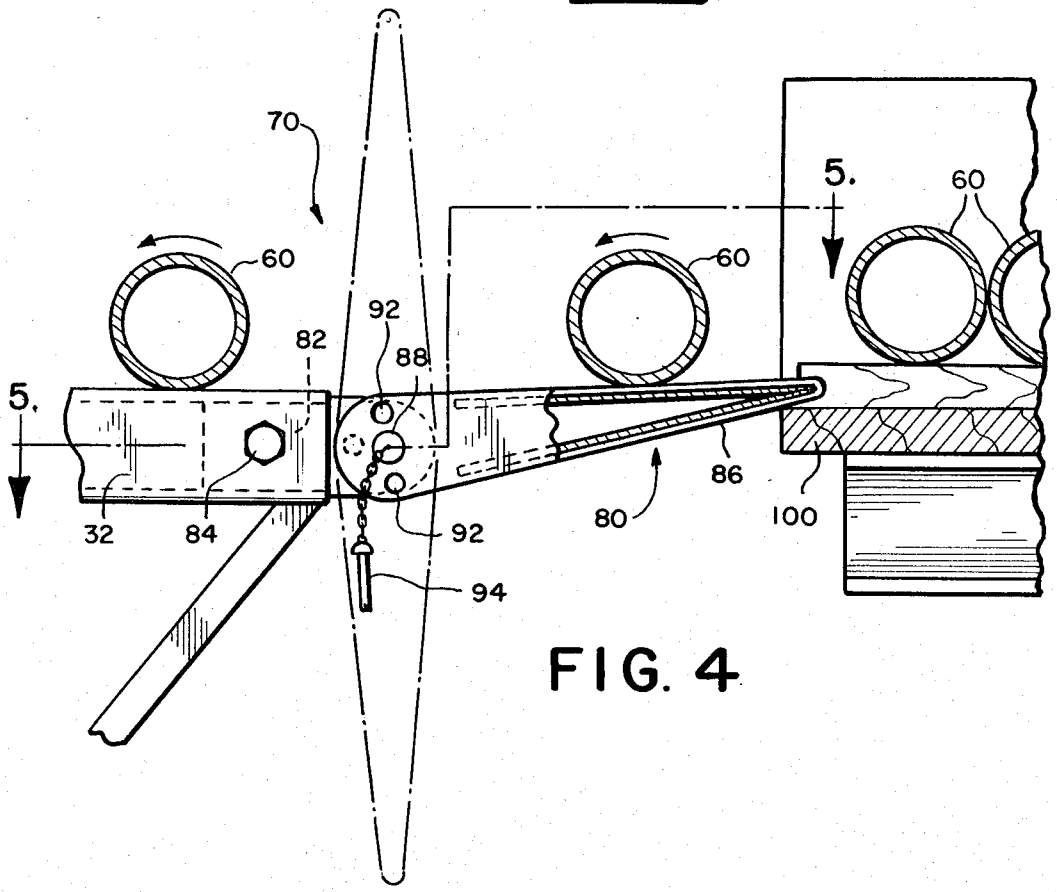
FIG. 4 is an enlarged side elevational view of a portion of the embodiment of FIG. 1.

Turning now to FIGS. 4 and 5, a first end 70 of the rail 32 serves to support a ramp 80. This ramp 80 is made up of a plug 82 sized to fit within the rail 32 and an arm 86. The arm 86 is pivotably connected to the plug 82 by means of a pivot pin 88, and the plug 82 is securely held in place inside the rail 32 by means of a bolt 84. The arm 86 is provided with a tapering cross section such that the distal end of the arm 86 is narrow in cross section.

As best shown in FIG. 4, the ramp 80 can be used to facilitate the loading of drilling tubulars on to the rack. FIG. 4 depicts the use of the ramp 80 to assist in the unloading of drilling tubulars 60 from the bed of a truck 100 onto the rack.

The ramp 80 can also be used as a stop to prevent drilling tubulars 60 on the rail 32 from rolling off the end of the rail 32. For this purpose, the arm 86 defines two locking holes 92, either of which can be aligned with a receiving hole 90 in the plug 82. A locking pin 94 can be used to secure the arm 86 in either the vertically upward or the vertically downward direction. It should be noted that the ramp 80 has been made entirely symmetrical, and when the ramp 80 becomes worn, the bolt 84 can be removed and the entire ramp 80 can be rotated 180° to extend its useful life.

Turning now to FIGS. 6 through 9, the rail 32 is provided with a second end 110 which is used for transferring drilling tubulars 60 between the rack and a transfer arm (not shown). A mounting block 112 is rigidly secured, as for example by welding, to the second end 110 of the rail 32. This mounting block 112 serves to support a shaft 114 which extends along the longitudinal direction defined by the rail 32. This shaft 114 serves to support two spaced bearings 116 which in turn support a roller 118. The bearings 116 allow the roller 118 to roll about an axis oriented parallel to the rail 32. A disc-shaped stop plate 120 is rigidly secured to the end of the shaft 114, and a V-shaped groove 122 is formed in an exterior surface of the roller 118 at a point near the stop plate 120. The stop plate 120 serves to prevent drilling tubulars 60 from rolling off the end of the roller 118, and the groove 122 performs a centering function. Drilling tubulars 60 tend to rest in the groove 122, thereby centering drilling tubulars of various diameters at the same point. The roller 118 serves to facilitate movement of a drilling tubular placed thereon in a direction perpendicular to that of the rail 32.

Figures 6, 6A, 7, 8, 9:
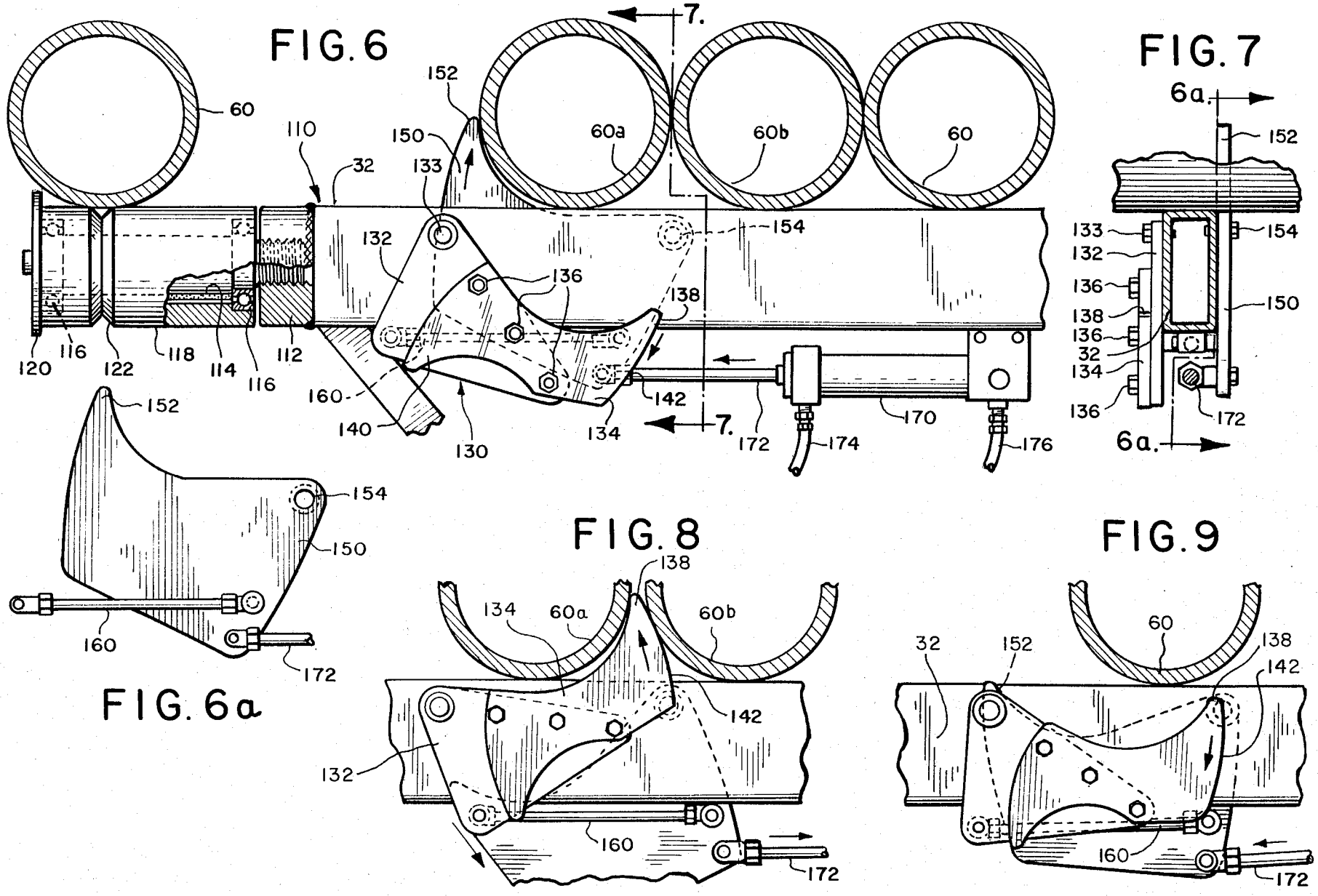
FIG. 6 is an enlarged side elevational view of a portion of the embodiment of FIG. 1.
FIG. 6*a* is a partial sectional view taken along line 6*a*—6*a* of FIG. 7.
FIG. 7 is a partial sectional view taken along line 7—7 of FIG. 6.
FIG. 8 is a partial side elevational view corresponding to the central portion of FIG. 6 showing the stop members in an alternate position.
FIG. 9 is a partial side elevational view corresponding to the central portion of FIG. 6 showing the stop members in a third orientation.

As shown in FIGS. 6 and 7, a first stop member 130 is mounted near the second end 110 of the rail 32. This first stop member 130 is made up of a pivot plate 132 which is pivotably mounted on the rail 32 at a pivot axis 133. A tang plate 134 is reversably mounted to the pivot plate 132 by means of three fasteners 136. This tang plate 134 defines first and second tangs 138, 140. By removing the fasteners 136, the tang plate 134 can be separated from the pivot plate 132 and turned end for end before being remounted. Thus, either of the two tangs 138,140 can be placed in the operative position.

A second stop member 150 is also mounted to the rail 132 such that the rail 32 is situated between the first stop member 130 and the second stop member 150. The second stop member 150 pivots about a pivot axis 154 and defines a tang 152. The two stop members 130, 150 are coupled together by means of a tie rod 160. This tie rod 160 couples the two stop members 130,150 such that they move in opposition, as explained in detail below.

An actuator 170 such as an air cylinder is rigidly mounted to the rail 32, and is coupled to the second stop member 150 by means of a piston rod 172. This actuator 170 is powered by two air lines 174, 176, and is so arranged that high pressure in the line 174 causes the piston rod 172 to move towards the actuator 170, and high pressure in the air line 176 causes the piston rod 172 to move away from the actuator 170.

Figure 10:
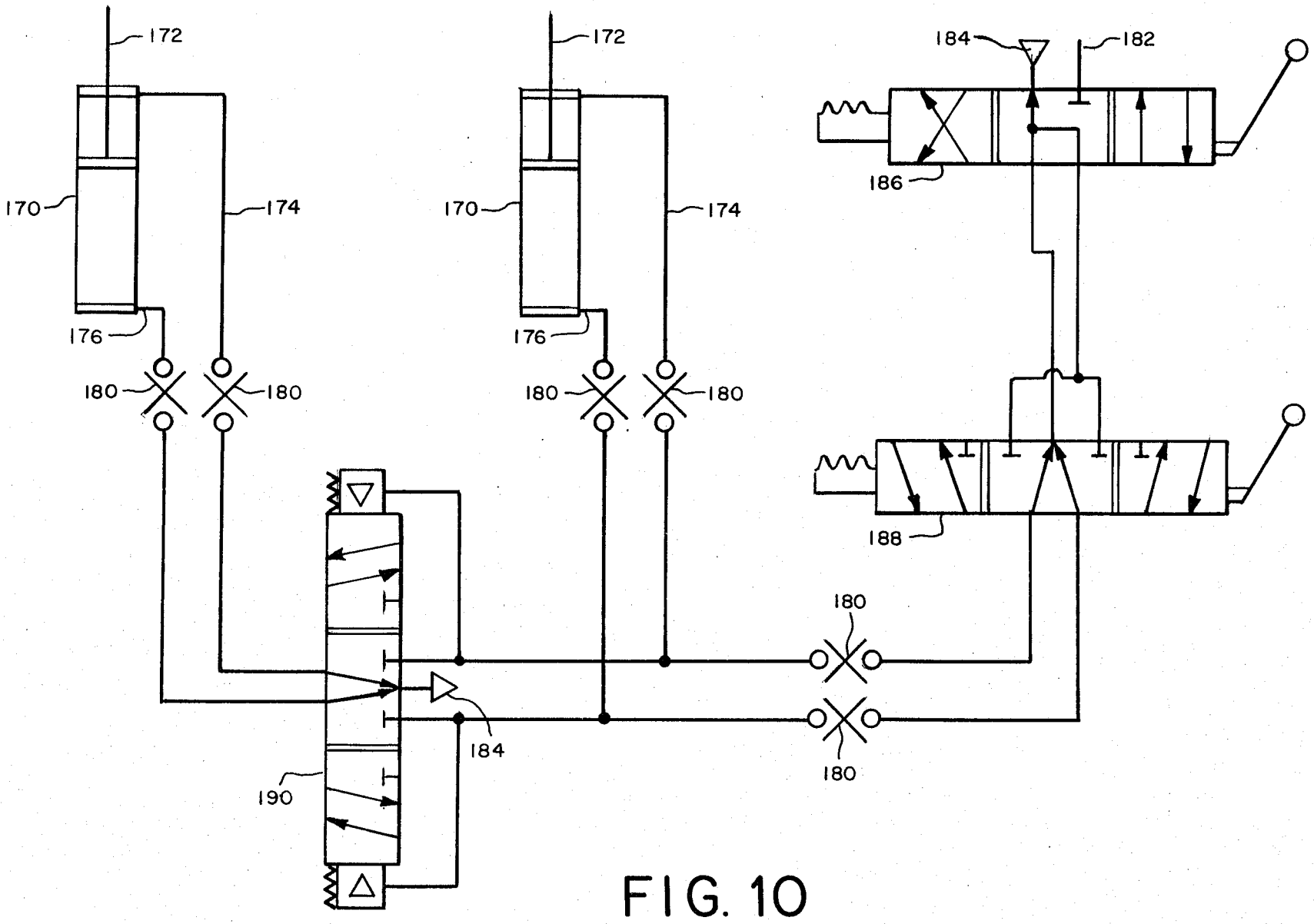
FIG. 10 is a schematic diagram of a pneumatic circuit suitable for controlling the embodiment of FIGS. 1–9.

FIG. 10 illustrates pneumatic control valves which can be used to control the actuator 170. It will be understood that typically two of the racks of this invention will be used together, and that the actuators 170 of these two racks will be cycled in coordination. The pneumatic diagram of FIG. 10 illustrates the manner in which two such air cylinders 170 can be controlled. In FIG. 10, reference numeral 180 is used to designate quick disconnects which are provided to facilitate disassembly of the system for transport. Paired, color coded air lines can be used to facilitate setup.

In FIG. 10, the valves 186, 188, 190 are used to regulate the flow of compressed air from the compressed air source 182 to the actuators 170, as well as the flow of air from the actuators 170 to exhaust ports 184. When the valves 186, 188, 190 are in the position shown in FIG. 10, each of the actuators 170 is vented to atmosphere and valves 186, 188 can be manually positioned as desired. Valve 190 provides more rapid exhausting of air from the remote actuator 170. By appropriately manipulating the valves 186, 188, the actuators 170 can be made to position the piston rods 172 as either extreme of movement. Valve 188 can be eliminated in applications where it is not necessary to control the actuators 170 from two spatially separated control stations.

The operation of the preferred embodiment shown in the drawings can best be understood by reference to FIGS. 1, 3, 6, 8, and 9. Turning to FIGS. 1 and 3, the jack 50 can be used to adjust the tilt angle of the rail 32 with respect to the base 10 as desired. As shown in FIG. 3, this is done by first positioning a hydraulic jack 50 on the jack support structure 26 such that the jack 50 is directly beneath the lower end 48 of the column 40. The jack 50 is then used to take the load of the rail 32 off the upper nut 44, and the nuts 44, 46 are then backed away from the plate 24. The column 40 is free to slide through the opening 28 in the top plate 24, and the jack 50 is then used to position the column 40 as desired to obtain the desired height and tilt angle of the rail 32. Once the rail 32 is properly positioned, the nuts 44, 46 are screwed into position against the plate 24 in order to lock the column 40 in position securely. Once this has been accomplished, the jack 50 can then be removed and used on another column 40.

An important advantage of this approach is that the large, long term, static loads on the rail 32 are borne by the mechanical lock nuts 44, and slow leakage of hydraulic lines and jacks is therefore not an important problem. Furthermore, this approach allows construction of a low cost system in which a single jack 50 can be used consecutively at a number of pedestals 20. Of course, it should be understood that this invention is not restricted to use with jacks such as those shown. Rather, other means for elevating the columns 40 can be used, such as manually activated or powered drives of various sorts.

Thus, the embodiment shown in the drawings can readily be tilted as desired. By way of example, FIG. 1 shows a situation in which the rail 32 is caused to slope downwardly toward the second end 110. Such a tilt angle is useful, for example, when drilling tubulars 60 are being unloaded from the rail 32 to a transfer arm (not shown) aligned with the roller 118, because drilling tubulars are caused to roll downwardly, toward the roller 118. Conversely, when the rack is used to store drilling tubulars 60 placed on the roller 118 by a transfer arm (not shown), it will generally be preferable to adjust the tilt angle of the rail 32 such that drilling tubulars 60 roll away from the roller 118 toward the ramp 80. When so used, the ramp 80 should be positioned with the arm 86 extending vertically upwards (as shown in dotted lines in FIG. 4).

Turning now to FIGS. 6 through 9, the first and second stop members 130, 150 act to control the movement of drilling tubulars 60 on the rail 32 so as to dispense them one at a time from the rail 32 to the roller 118. FIG. 6 shows the position of the first and second stop members 130, 150 when the actuator 170 is positioned with the piston rod 172 in its extended position. In this position, the first stop member 130 is in the lower position, in which the entire stop member 130 is positioned below the upper edge of the rail 32. When the first stop member 130 is in the lower position shown in FIG. 6, the second stop member 150 is in the upper position, in which the tang 152 extends above the rail 32. In this position, the tang 152 acts as a stop, preventing drilling tubulars 60 from rolling beyond the tang 152 towards the roller 118.

FIG. 8 shows the positions of the first and second stop members 130, 150 when the actuator 170 is used to pull the piston rod 172 towards the actuator 170. In this position, the second stop member 150 is moved to the lower position, in which the tang 152 and in fact the entire stop member 150 are positioned below the upper surface of the rail 32. In this position, the first stop member 130 is pivoted to the upper position, in which the outermost tang 138 moves above the upper edge of the rail 32.

As shown in FIGS. 6 and 8, when the second stop member 150 is in the upper position, it serves to position a first drilling tubular 60*a*, and to restrain the movement of this drilling tubular 60*a* towards the roller 118. When the actuator 170 is used to move the second stop member 150 into the lower position (as shown in FIG. 8) the first drilling tubular 60*a* is allowed to roll down the rail 32 onto the roller 118. Simultaneously, the first stop member 130 is interposed between the first drilling tubular 60*a* and an adjacent drilling tubular 60*b*. The tang 138 of the first stop member 130 serves simultaneously to accelerate the first drilling tubular 60*a* towards the roller 118 and to prevent the downward movement of the adjacent drilling tubular 60*b*. In order to minimize the forces placed on the actuator 170, it is preferable that the heel 142 of the tang 138 be configured as an arc having a radius of curvature centered at the pivot axis 133. In this way, the shifting of the adjacent drilling tubular 60*b* is minimized. Once the first drilling tubular 60*a* has moved onto the roller 118, the actuator 170 is used to raise the second stop member 150 to the upper position shown in FIG. 6, thereby allowing the adjacent drilling tubular 60*b* to roll downwardly into the position previously occupied by the first drilling tubular 60*a*.

From the foregoing description it should be apparent that the tang 138 is designed to move into the region between two drilling tubulars as shown in FIG. 8. In order to provide a system which works particularly well with a wide range of sizes of drilling tubulars, the tang plate 134 is mounted reversably to the pivot plate 132. By merely removing the fasteners 136, turning the tang plate 134 end for end, and resecuring the tang plate 134 to the pivot plate 132, the first stop member 130 can simply be reconfigured to work with another size drilling tubular. Multiple tang plates 134 of varying dimensions can be provided to extend the range of sizes of drilling tubulars that can be handled properly.

FIG. 9 shows another mode of operation of the rack of this invention. In this mode, the actuator 170 is vented to atmosphere via both of the air lines 174, 176. The first and second stop members 130, 150 are then manually positioned such that neither stop member 130, 150 extends above the uppermost surface of the rail 32. This orientation of the stop members 130, 150 is useful particularly when the rack is used to receive drilling tubulars from a transfer arm (not shown). In this mode of operation, the first end 70 of the rail 32 is typically placed at a lower elevation than that of the second end 110. Drilling tubulars which are deposited on the roller 118 then roll by force of gravity down the rail 32 towards the first end 70 of the rail 32. Of course, when drilling tubulars are deposited one at a time on the rail 32, the metering function performed by the first and second stop members 130, 150 is no longer essential. In this situation, the first and second stop members 130, 150 can simply be stowed in the position shown in FIG. 9.

From the foregoing, it should be apparent that an improved rack for drilling tubulars has been described which can readily be tilted as necessary to provide automatic movement of the drilling tubulars stored thereon, and which includes a dispensing mechanism which serves to restrict the movement of the drilling tubulars such that they are released one at a time onto an off-loading position. This invention can be embodied in simple, reliable, low cost devices which are well suited for field operations. For example, when an air cylinder of the type described above is used, a particularly reliable system is obtained. This is because air is simply exhausted to atmosphere, and is not returned to a central reservoir. In this way, problems related to contamination and dirt are minimized. Furthermore, the illustrated ramp provides continuous adjustment of the tilt angle of the rail, thereby eliminating problems caused by discrete adjustability.

Of course, it should be understood that various changes and modifications of the preferred embodiment described will be apparent to those skilled in the art. For example, the actuator can be controlled automatically by the transfer arm controls or by means for sensing the position of a transfer arm. Furthermore, hydraulic actuators or electric solenoids can be substituted for pneumatic actuators of the type shown, and the entire rack can be scaled or modified as necessary to fit individual applications. In addition, the nuts 44,46 and the threaded columns 40 can be replaced with other structures such as collar clamps and unthreaded shafts or even hydraulic cylinders permanently mounted between the support structure 26 and the attachment points 36. It is, therefore, intended that the foregoing description be regarded as illustrative rather than as limiting, and that it be understood that it is the following claims, including all equivalents, which are intended to define the scope of this invention.

I claim:

1. A rack for drilling tubulars, said rack comprising:

a base having two spaced support pedestals mounted thereon;

a support member having two spaced attachment members mounted thereon;

first and second columns;

means for mounting each of the first and second columns between a respective one of the support pedestals and a respective one of the attachment members to interconnect the base with the support member;

said base, support member, columns and mounting means configured to support a plurality of drilling tubulars extending transverse to the support member; and means, included in the mounting means, for independently adjusting the positions of the first and second columns to independently control the tilt and the elevation of the support member with respect to the base such that either end of the support member can be elevated above the other end of the support member in order to cause drilling tubulars supported on the support member to roll to either selected end of the support member;

each of the pedestals comprising a plate having an opening passing therethrough, each of the columns being threaded and passing through the opening in a respective one of the plates, and the mounting means comprising a pair of nuts, each threadedly engaged to a respective one of the columns and positioned adjacent to and over the respective plate such that downward forces are passed via the columns, the nuts, and the plates to the pedestals.

2. The invention of claim 1 wherein the adjusting means comprises two jack support structures, each mounted to a respective one of the two pedestals and configured to support a jack under the respective column and to provide a reaction point therefor.

3. A rack for drilling tubulars, said rack comprising:

a base having two spaced support pedestals mounted thereon;

a support member having two spaced attachment members mounted thereon;

first and second columns;

means for mounting each of the first and second columns between a respective one of the support pedestals and a respective one of the attachment members to interconnect the base with the support member;

said base, support member, columns and mounting means configured to support a plurality of drilling tubulars extending transverse to the support member;

means, included in the mounting means, for independently adjusting the positions of the first and second columns to independently control the tilt and the elevation of the support member with respect to the base such that either end of the support member can be elevated above the other end of the support member in order to cause drilling tubulars supported on the support member to roll to either selected end of the support member; and a ramp pivotably secured to one end of the rail so as to pivot in a vertical plane about on a horizontal axis vertically aligned with the rail to form a continuation of the rail such that a drilling tubular can roll off the rail, onto a portion of the ramp adjacent to the axis, said ramp tapering to a section of reduced cross sectional area at a point distal from the rail.

4. The invention of claim 3 further comprising:

means for locking the ramp in a vertically oriented position.

5. A rack for drilling tubulars, said rack comprising:

a base having two spaced support pedestals mounted thereon;

a support member having two spaced attachment members mounted thereon;

first and second columns;

means for mounting each of the first and second columns between a respective one of the support pedestals and a respective one of the attachment members to interconnect the base with the support member;

said base, support member, columns and mounting means configured to support a plurality of drilling tubulars extending transverse to the support member;

means, included in the mounting means, for independently adjusting the positions of the first and second columns to independently control the tilt and the elevation of the support member with respect to the base such that either end of the support member can be elevated above the other end of the support member in order to cause drilling tubulars supported on the support member to roll to either selected end of the support member;

a first stop member pivotably mounted to the support member, said first stop member pivotable between an upper position, in which a portion of the first stop member extends above the support member, and a lower position, in which the first stop member is positioned not be extend above the support member;

a second stop member pivotably mounted to the support member, said second stop member pivotable between an upper position, in which a portion of the second stop member extends above the support member, and a lower position, in which a portion of the second stop member extends above the support member, and a lower position, in which the second stop member is positioned not to extend above the support member; and means for causing the first and second stop members to move in opposition such that the first stop member is in the upper position when the second stop member is in the lower position, and vice versa;

said first and second stop members positioned such that when the second stop member is in the upper position with a first tubular positioned against the second stop member and the first stop member is moved to the upper position, the first stop member fits between the first tubular and an adjacent tubular, thereby restraining movement of the adjacent tubular.

6. The invention of claim 5 wherein the moving means further comprises:

a tie rod mounted between the first and second stop members; and an actuator coupled to one of the first and second stop members.

7. The invention of claim 5 wherein the moving means comprises:

an actuator coupled to at least one of the first and second stop members;

a first manually operated valve coupled to the actuator to control the flow of a pressurized fluid to the actuator; and an automatic valve coupled to the actuator and responsive to the manually operated valve to speed the rate at which the actuator responds to the manually operated valve.

8. The invention of claim 7 wherein the moving means further comprises a second manually operated valve spatially separated from the first manually operated valve and coupled to the actuator to control the flow of the pressurized fluid to the actuator such that the actuator can be controlled from two spatially separated locations.

9. In a rack for drilling tubulars, said rack having a rail adapted to support the tubulars, the improvement comprising:

a first stop member mounted to the rack adjacent the rail so as to move between an upper position, in which a portion of the first stop member extends above the rail, and a lower position, in which the first stop member does not extend above the rail;

a second stop member mounted to the rack adjacent the rail so as to move between an upper position, in which a portion of the second stop member extends above the rail, and a lower position, in which the second stop member does not extend above the rail;

means for moving the first and second stop members in opposition such that the first stop member is in the upper position when the second stop member is in the lower position, and vice versa;

said first and second stop members positioned such that when the second stop member is in the upper position with a first tubular positioned against the second stop member and the first stop member is moved to the upper position, the first stop member fits between the first tubular and an adjacent tubular, thereby restraining movement of the adjacent tubular;

said first stop member comprising:

a first plate pivotably mounted to the rail to pivot about an axis; and a second plate reversably secured to the first plate such that a second plate is mountable to the first plate in first and second orientations, said second plate having first and second tangs positioned such that the first tang extends above the rail when the second plate is in the first orientation and the first plate is positioned in a selected range of orientations and the second tang extends above the rail when the second plate is in the second orientation and the first plate is positioned in the selected range of orientations, the spacing between the first tang and the axis when the second plate is in the first orientation being greater than the spacing between the second tang and the axis when the second plate is in the second orientation.

10. An improved rack for drilling tubulars, said rack comprising:

a base including two spaced pedestals, each of which includes a respective plate which defines a respective opening therethrough;

a pair of threaded columns, each of which extends through the opening in the respective plate;

a support rail secured to the two columns such that the tilt of the rail is determined by the vertical positions of the columns;

means for mounting each of the columns to the respective plates to interconnect the base with the rail;

means, included in the mounting means, for independently adjusting the positions of the two columns to independently control the tilt and the elevation of the rail with respect to the base such that either end of the rail can be elevated above the other end of the rail in order to cause drilling tubulars supported on the rail to roll to either selected end of the rail, said adjusting means comprising a pair of nuts, each of which is threadably engaged on a respective one of the columns above and adjacent the respective plate, such that downward forces applied to the columns are transmitted via the nuts to the respective plates and pedestals;

a first stop plate pivotably mounted to the rail adjacent one end thereof and movable between an upper position, in which a part of the first stop plate extends above the rail, and a lower position, in which the entire first stop plate is below an upper surface of the rail;

a second stop plate pivotably mounted to the rail opposite the first stop plate and movable between an upper position, in which a part of the second stop plate extends above the rail, and a lower position, in which the entire second stop plate is below the upper surface of the rail;

a tie rod interconnecting the first and second stop plates to cause them to move in opposition, such that when one of the stop plates is in the upper position, the other is in the lower position;

an actuator mounted to the rail and coupled to the stop plates to pivot the stop plates between the upper and lower positions;

each of the stop plates defining a respective tang which extends above the rail when the respective stop plate is in the upper position, the tangs so positioned that when a first drilling tubular rests against the tang of the second stop plate and the second stop plate is moved to the lower position, the tang of the first stop plate moves between the first tubular and a second tubular, positioned adjacent the first tubular.

11. The invention of claim 10 wherein the first and second stop plates are configured such that they simultaneously pivot into an intermediate position, in which no part of either of the stop plates extends above the upper surface of the rail.

* * * * *